United States Patent [19]

Fukuroi et al.

[11] 4,004,327

[45] Jan. 25, 1977

[54] SLIDE FASTENER

[75] Inventors: Takeo Fukuroi, Uozu; Moriyoshi Hayashi, Kurobe, both of Japan

[73] Assignee: Yoshida Kogyo Kabushiki Kaisha, Japan

[22] Filed: July 8, 1975

[21] Appl. No.: 594,053

[30] Foreign Application Priority Data

July 16, 1974 Japan ..... 49-84261[U]

[52] U.S. Cl. ..... 24/205.13 R; 24/205.16 R

[51] Int. Cl.[2] ..... A44B 19/06

[58] Field of Search ..... 24/205.13 R, 205.16 R

[56] References Cited

UNITED STATES PATENTS

| | | | |
|---|---|---|---|
| 1,680,266 | 8/1928 | Galat | 24/205.13 R |
| 2,463,840 | 3/1949 | Winterhalter | 24/205.13 R |
| 2,619,148 | 11/1952 | Camp | 24/205.13 R |

FOREIGN PATENTS OR APPLICATIONS

| | | | |
|---|---|---|---|
| 123,667 | 3/1947 | Australia | 24/205.13 R |
| 506,818 | 10/1954 | Canada | 24/205.13 R |
| 896,909 | 3/1945 | France | 24/205.13 R |
| 115,608 | 1/1946 | Sweden | 24/205.13 R |
| 696,368 | 8/1952 | United Kingdom | 24/205.13 R |

*Primary Examiner*—Bernard A. Gelak
*Attorney, Agent, or Firm*—Bucknam and Archer

[57] ABSTRACT

There is provided a slide fastener having a pair of oppositely disposed carrier tapes each carrying on and along one longitudinal beaded edge a series of discrete fastener elements. The fastener elements are each provided with a coupling head and a pair of legs extending from the coupling head and having oppositely disposed inner wall portions. There are formed a plurality of ledges integral with the element legs and projecting from the oppositely disposed inner wall portions. The ledges are smaller in thickness than the element legs.

1 Claim, 7 Drawing Figures

SLIDE FASTENER

BACKGROUND OF THE INVENTION

This invention relates generally to slide fasteners and in particular to a slide fastener of the type having a pair of series of discrete fastener elements attached astride respective longitudinal beaded edges of a pair of carrier tapes.

In the production of slide fasteners of the type described, it is now the common practice to provide discrete fastener elements made of a metal, each of which elements comprises a coupling head and a pair of legs extending therefrom and flared outwardly to assume a substantially, cross-sectionally V-shaped contour. In order to attach the fastener elements to the carrier tape, the legs are arranged astride a longitudinal beaded edge of the tape and then pressed toward each other into gripping engagement with the beaded edge. However, the prior art legs were provided with a smooth peripheral inner wall having oppositely disposed portions in each pair that are adapted to grip the beaded edge of the carrier tape. This has led to the drawback that the fastener elements are liable to tilt relative to and disengage from the beaded edge when repeatedly subjected to severe external stresses tending to loosen the legs gradually out of firm gripping engagement with the beaded tape edge. Furthermore, under these conditions, the fastener elements are prone to be displaced along the longitudinal beaded edge of the tape with the results that the pitch of adjacent fastener elements is disturbed, failing to interlock the opposed stringers in an orderly manner. Various attempts have heretofore been made to explore more effective and secure attachment of the fastener elements to the beaded edge of the carrier tape. One such attempt was to form alternate elongated ridges on and grooves in the peripheral inner wall of the legs, which ridges and grooves extend pitchwise throughout the entire thickness of the element. However, this effort suffered the difficulty that the fastener elements are not fully prevented from being displaced along the longitudinal beaded edge of the tape. Another attempt involved the provision of a groove or recess extending in the peripheral inner wall of the legs and longitudinally of the element. This arrangement, however, cannot eliminate the tendency of the fastener elements to become displaced tiltingly relative to and finally disengaged from the beaded tape edge, and is further disadvantageous in that because the beaded tape edge when gripped by the element legs is bulged into the groove, it is necessary to use extra beading material of high bulk and resiliency to compensate for the room of such groove.

SUMMARY OF THE INVENTION

With the above-noted prior art difficulties in view, the present invention has for its principal object to provide an improved slide fastener in which discrete fastener elements are mounted stably in position on and around the longitudinal beaded edge of a carrier tape.

It is another object of the invention to provide a slide fastener having a pair of stringers which can be coupled and uncoupled with utmost accuracy and stability and used for extended periods of time.

These and other objects and advantages will become more apparent as the description proceeds with the aid of the accompanying drawings in which like reference numerals denote like parts throughout the several views.

DESCRIPTION OF THE PREFERRED EMBODIMENTS

Figure 1:
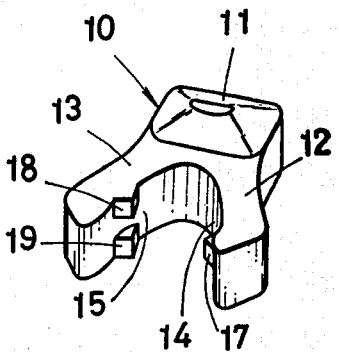
FIG. 1 is a perspective view of an individual fastener element constructed according to the present invention.
Figure 2:
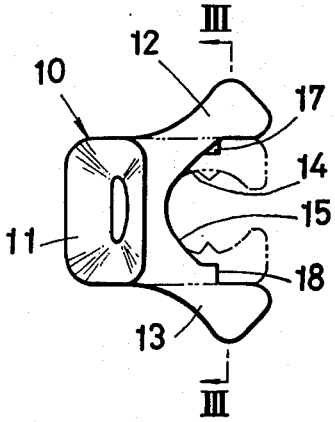
FIG. 2 is a top plan view of the fastener element shown in FIG. 1.
Figure 3:
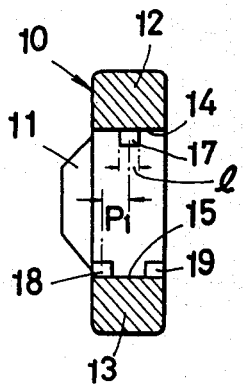
FIG. 3 is a cross-sectional view taken along the line III—III of FIG. 2.

Referring now to the drawings and particularly to FIGS. 1 through 3, there is shown a fastener element or scoop generally designated at 10 which is formed by, for example, cutting a cross-sectionally Y-shaped bar made of a metal. The element 10 has a coupling head 11, and a pair of legs 12 and 13 extending from the coupling head 11 and flared outwardly in its initial form; i.e., prior to attachment to the tape, to assume a substantially, cross-sectionally V-shaped configuration. The legs 12 and 13 are provided with oppositely disposed inner wall portions 14 and 15, respectively, that are adapted to grip or clamp around a beaded edge 16 (FIG. 4) when the legs 12 and 13 are pressed toward each other until they assume the position as indicated by the imaginary lines of FIG. 2.

According to an important aspect of the invention, there is provided a ledge or tooth 17 of a cross-sectionally triangular shape, for example, which ledge is formed integral with the leg 12 and projects from the wall portion 14 toward the opposed leg 13. There are also provided a pair of similar ledges or tooth 18 and 19 of a cross-sectionally triangular shape, for example, which ledges are formed integral with the leg 13 and project from the wall portion 15 toward the opposed leg 12. FIG. 3 shows that the thickness (l) of these ledges 17, 18 and 19 is smaller than that of the legs 12 and 13 of the element 10. As seen from FIGS. 1 and 3, that first ledge 17 is situated centrally of the thickness of the leg 12, whereas the twin ledges 18 and 19 are spaced apart from each other in the longitudinal direction of the carrier tape and located at the lateral marginal edges of the wall portion 15. It will be seen that the ledge 17 is placed pitchwise of the element out of registry with the ledges 18 and 19 by a given distance $P_1$, so that the ledge 17 is opposed to an intermediate point between the ledges 18 and 19. It will be noted that when the legs 12 and 13 assume the position of imaginary lines of FIG. 2, that is, the element 10 is mounted astride the beaded tape edge 16, the ledge 17 is disposed in diametrically opposed relation to the opposed ledges 18, 19 as seen particularly in FIG. 2.

Figure 4:
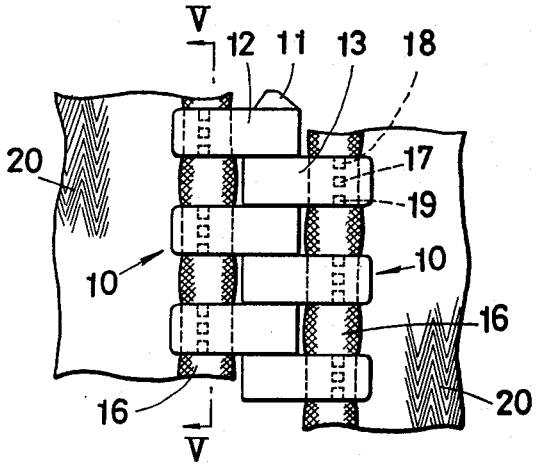
FIG. 4 is a fragmentary plan view of a pair of fastener stringers shown in coupled condition, and having mounted thereon the fastener elements of the invention.
Figure 5:
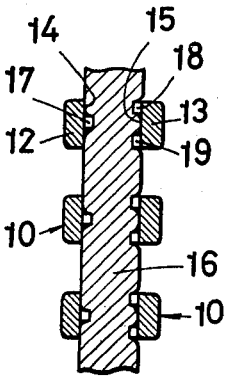
FIG. 5 is a cross-sectional view taken along the line V—V of FIG. 4.

Referring now to FIGS. 4 and 5, when the fastener elements 10 thus constructed are attached to the carrier tapes 20, the opposed wall portions 14 and 15 of the legs 12 and 13 are pressed against and around the beaded edges 16 extending longitudinally of the tapes 20 until the ledges 17, 18 and 19 are brought into engagement with and bite into the beaded edges 16. Since the ledge 17 and the opposed ledges 18, 19 are displaced pitchwise of the element from each other and engage with the beaded edge 16 at the diametrically opposed points, these ledges 17, 18 and 19 are held in firm biting engagement with the sandwiched beaded edge 16 as viewed in FIG. 5. Accordingly, the fastener elements 10 are held stably in position on and around the beaded tape edge 16 against displacement which would otherwise occur pitchwise of the element or along the longitudinal beaded edge 16 under the influence of external stresses. It will also be noted that since the ledges 17, 18 and 19 are kept in firm, gripping engagement with the beaded edge 16, the fastener elements 10 are prevented from tilting relative to and disengaging from the beaded edge 16 even when repeatedly subjected to severe external stresses.

A close inspection of FIG. 5 indicates that the beaded edge 16 engages firmly with only one ledge at any optional, cross-sectional plane of the beaded edge where the element is supported, thereby preventing the beaded edge 16 from being pressed excessively. With this structure, the beaded tape edges 16 can be fabricated of a less bulky and resilient textile material than those used in the prior art slide fasteners in which the beaded tape edge is clamped by at least two ridge and groove of the elements at any one cross-sectional plane of the element-carrying beaded edge, or the beaded edge is bulged into a groove formed in and along the peripheral inner wall of the element legs.

Figure 6:
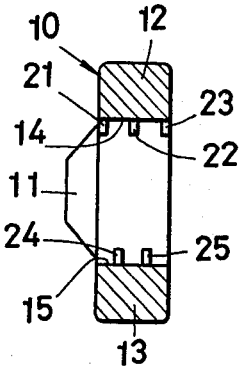
FIG. 6 is a view similar to FIG. 3, but showing another embodiment of the invention.
Figure 7:
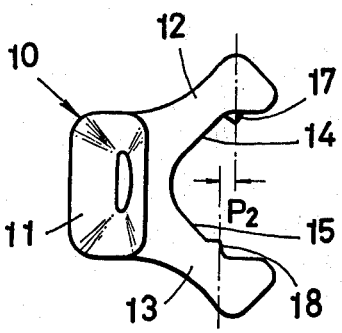
FIG. 7 is a view similar to FIG. 2, but showing a modified form of the fastener element according to the invention.

FIG. 6 shows another preferred embodiment of the invention wherein the wall portion 14 of the leg 12 is provided with three spaced ledges 21, 22 and 23, whereas the wall portion 15 of the leg 13 is provided with two spaced legs 24 and 25. It will be appreciated that the ledges 21, 22 and 23 and the opposed ledges 24, 25 are displaced pitchwise of the element from each other so as to ensure more firm clamping engagement with the beaded tape edge 16. According to the modification illustrated in FIG. 7, the ledge 17 and the opposed ledges 18, 19 are further displaced from each other in the longitudinal direction of the fastener element 10 by a given distance $P_2$, so that when clamped around the beaded edge 16, the ledge 17 and the opposed ledges 18, 19 will be orientated out of registry with each other.

It should be understood that the structures herein described are merely illustrative of the principles of this invention and that modifications may be made without departing from the scope of the appended claims.

What is claimed is:

1. A slide fastener including a pair of oppositely disposed carrier tapes each carrying on and along one longitudinal beaded edge a series of discrete fastener elements, said fastener elements each comprising a coupling head, a pair of legs extending from the coupling head and having oppositely disposed inner wall portions, and a plurality of teeth formed integral with said legs and projecting from said oppositely disposed inner wall portions, each of said teeth including a pair of inclined faces extending from an outer edge to an inner wall portion and lying in a direction transverse to said longitudinal direction thereby forming a tooth generally triangular in shape, said tooth also having two opposite generally flat faces generally perpendicular to said inner wall, each said flat face lying in a plane generally perpendicular to said longitudinal direction, the thickness between said flat faces being smaller than said legs as measured along the longitudinal direction of said beaded edge, each of said teeth on one leg being staggered and at a predetermined pitch spacing with respect to a corresponding tooth on the other leg as measured along said longitudinal direction, said teeth being disposed in gripping engagement with said beaded edge to secure the fastener elements thereto.

* * * * *